United States Patent [19]

Archer et al.

[11] Patent Number: 4,627,255

[45] Date of Patent: Dec. 9, 1986

[54] APPARATUS FOR BENDING METAL STRIP

[75] Inventors: John R. Archer; Michael J. Kellaway, both of Royston; Douglas S. MacArthur, Haslingfield, all of England

[73] Assignee: USM Corporation, Farmington, Conn.

[21] Appl. No.: 575,793

[22] Filed: Feb. 1, 1984

[30] Foreign Application Priority Data

Feb. 12, 1983 [GB] United Kingdom ..... 8303954

[51] Int. Cl.[4] ..... B21D 5/00

[52] U.S. Cl. ..... 72/10; 72/21; 72/31; 72/388; 72/702

[58] Field of Search ..... 72/8, 10, 31, 33, 34, 72/21, 307, 388, 389, 702, 387, 12, 9

[56] References Cited

U.S. PATENT DOCUMENTS

| | | | |
|---|---|---|---|
| 3,352,136 | 11/1967 | Clarke | 72/702 |
| 3,440,847 | 4/1969 | Giordano | 72/30 |
| 3,812,694 | 5/1974 | Peddinghaus | 72/702 |
| 4,173,884 | 11/1979 | Dobinson | 72/387 |

FOREIGN PATENT DOCUMENTS

| | | | |
|---|---|---|---|
| 2704399 | 8/1978 | Fed. Rep. of Germany | 72/702 |
| 1394772 | 5/1975 | United Kingdom | 72/388 |
| 2072551 | 10/1981 | United Kingdom | 72/34 |

*Primary Examiner*—Daniel C. Crane

*Attorney, Agent, or Firm*—Spencer T. Smith

[57] ABSTRACT

In a bending machine, metal strip (42) is bent by a sequence of steps including longitudinal advance of the strip (42) alternating with bending of the strip by a movable tool (18) which engages and deflects the strip when the latter is restrained against longitudinal movement. Provision is made for checking or inspecting the permanent angular deformation of each bend applied to the strip, to take account of the tendency of the metal strip to spring back after bending. Compensation for spring-back is achieved by use of a previously described characteristic relating displacement of the bending tool to the resultant permanent angle of bend applied to the strip. Further compensation is provided to remove an error which can arise if the bending tool is movable along a line of action spaced from the point of bending of the strip by an amount greater than the incremental advance of the strip.

4 Claims, 7 Drawing Figures

APPARATUS FOR BENDING METAL STRIP

FIELD OF THE INVENTION

This invention relates to apparatus for and methods of bending metal strip. The invention is of particular, but not exclusive, application to the bending of metal strip to form cutting blades for cutting out panels of sheet material such as leather.

BACKGROUND TO THE INVENTION

To achieve the desired degree of accuracy in the profile of bent strip it has been found that provision should be made for checking the accuracy of the permanent angular deformation of each bend.

This need arises principally from the tendency of the metal strip to spring back after bending, the extent of spring-back being variable in that it tends to differ from strip to strip and to be dependent on the angle of bend imparted.

In one aspect the invention aims to provide a way of checking or inspecting the permanent angular deformation applied to the strip and in another aspect the invention provides compensation for spring back of the strip. It will be appreciated that these two aspects are linked, in that the inspection principally checks that proper compensation has been made for spring-back, but there may be situations where these two aspects are separately and independently used.

A further aspect of the invention aims to compensate for an error which can arise if the bending tool is movable along a line of action spaced from the point of bending of the strip by an amount greater than the incremental advance of the strip. Under these circumstances, it is desirable to compensate for the fact that one or more previous bends are located between the bending tool and the point of bending of the strip.

SUMMARY OF THE INVENTION

According to one aspect of the invention a machine for bending metal strip comprises guide means for guiding longitudinal movement of the strip, feed means for feeding the strip through the guide means towards an exit end thereof, and a bending tool spaced from the exit end and movable in a controlled manner into lateral engagement with the strip so as to bend the strip about the exit end of the guide means, wherein the tool and the strip are such that physical contact between them gives rise to an electrical signal which is used to check the permanent angular deformation applied to the strip. Preferably, the tool and the strip are electrically insulated from one another, so that physical contact can be readily detected electrically. In the preferred embodiment to be described, the tool is electrically insulated from the remainder of the machine and the strip, the tool being at a potential which drops to zero on contact with the strip. This step in tool potential is the electrical signal which is sensed. By recourse to this aspect of the invention the permanent angular deformation in the strip can be checked by moving the tool towards the strip, sensing the electrical signal which arises when the tool and strip make contact and deriving the permanent angular deformation in the strip from the magnitude of movement of the tool.

The tool is preferably movable in an arcuate line of action and retractable to enable the tool to be disposed on one or other side of the strip, depending on which direction the bend is to be applied to the strip. The tool is conveniently in the form of a pin mounted for retracting movement in a metal block mounted in the machine by means of an electrically insulating bearing affording rotational movement of the block in order to move the pin along its arcuate line of action. Extension and retraction of the pin relative to the metal block may be effected by means of a pneumatic cylinder having an electrically insulating piston for driving the pin towards its extended position and retaining it there, spring means being provided to retract the pin when the supply of pressure air to the pneumatic cylinder is interrupted.

An electrical connection may be made to the metal block to sense the electrical signal produced when contact is made between the pin and the metal strip being bent.

In the embodiment to be described the feed means advance the strip material incrementally, and the strip is bent as a result of a series of longitudinal advancing movements alternating with a series of small deflections applied to the strip by the tool when the strip is held against longitudinal movement.

It is envisaged that a bending machine according to the invention would be controlled by a microcomputer which issues appropriate instructions to the feed means and the bending tool so that the succession of incremental advances of the strip and the incremental bends applied to the strip give the required strip profile.

Checking of the permanent deformation applied to the strip by sensing when the tool contacts the strip requires that there is an established relationship between angular position (or angular displacement) of the tool when in contact with the strip and the angle of bend in the strip. This relationship is conveniently derived, as an initial calibration step, by moving the tool into contact with a strip or strips having known angles of bend, deriving a series of points and fitting a curve through the points to establish the relationship. The curve will normally be a polynomial, the order of which is chosen to provide reasonable accuracy without excessive complication.

In practice, a sixth order polynomial has been found to be suitable. This polynomial is held in the microcomputer and used to interpret the angles sensed by the tool during checking or inspection of the permanent angular deformation applied to the strip being bent.

In said one aspect the invention also provides a method of bending metal strip, wherein the permanent deformation applied to the strip by a bending tool is checked by sensing an electrical signal which is produced when the tool makes physical contact with the strip. To check the accuracy of a bend, the tool may be first driven in quickly towards the expected position of the strip and then moved slowly towards the strip until contact is made, whereupon production of the electrical signal causes further tool movement to cease until the next tool instruction is received.

According to another aspect of the invention a machine for bending metal strip comprises guide means for guiding longitudinal movement of the strip, feed means for feeding the strip through the guide means towards an exit end thereof, and a bending tool spaced from the exit end and movable in a controlled manner into lateral engagement with the strip so as to bend the strip about the exit end of the guide means, wherein the machine compensates for the spring-back of the strip after bending by means of a previously derived characteristic relating displacement of the bending tool to the resulting permanent angle of deformation applied to the strip.

This characteristic is preferably derived by displacing the tool through a series of known magnitudes of displacement and causing a series of bends to be introduced into the strip, allowing the strip to spring-back after each bend, and detecting the permanent deformation in the strip after each bend by moving the tool into contact with the permanently deformed strip, sensing when the tool contacts the strip and deriving therefrom the permanent deformation corresponding to each known magnitude of displacement.

Contact between the tool and strip is preferably sensed electrically, by arranging for the tool and strip to be electrically insulated from one another, as previously described for the checking or inspection aspect of the invention. The characteristic relating tool displacement to resulting permanent deformation may again be a polynomial (e.g. of sixth order) with variables selected to give a curve passing through or close to the points found experimentally by the method described above.

The characteristic is preferably stored within a microcomputer controlling the bending machine, so that the computer can instruct tool movement corresponding to the required angle of bend.

Different characteristics can be stored within the computer for different strip materials or batches of strip material. Further, adjustment of any of these characteristics can be made if the checking or inspection reveals a persistent trend of under or over bending.

According to a further aspect of the invention a machine for bending metal strip comprises guide means for guiding longitudinal movement of the strip, feed means for incrementally feeding the strip through the guide means towards an exit end thereof, and a bending tool spaced from the exit end and movable in a controlled manner into lateral engagement with the strip so as to bend the strip about the exit end of the guide means, the strip being bent by a series of incremental advancing movements alternating with bending of the strip when held against longitudinal movement, wherein the tool is movable along a line of action spaced from the exit end by a distance greater than the smallest incremental feed dimension, and compensation is provided for one or more previous bends being located between the exit end and the line of action of the tool, said compensation being provided by modifying the displacement of the tool to take account of said one or more previous bends.

In the prefered case of the tool being movable along an arcuate line of action, compensation is provided by algebraically adding to the instructed tool angle an offset angle calculated to compensate for any previous bends located between the line of action and the exit end. The offset angles are preferably computed from trigonometric relationships held in a microcomputer controlling the machine, so that the tool is automatically instructed to move through angles which include any compensation for the offset angle.

As an alternative to deriving the offset angle from any previous bends located between the exit end and the line of action of the tool, the tool may be moved until it contacts the strip, after which the tool is then moved by the instructed angle.

The invention will now be further described, by way of example with reference to the accompanying drawings, in which:

FIG. 1 is a plan view of the bending region of a bending machine according to the invention, FIG. 2 is a digrammatic side view of the structure below the bending region, FIG. 3 is a diagrammatic plan view indicating how checking or inspection is carried out of the permanent bend angles applied to a metal strip bent in the machine, FIG. 4 is a diagrammatic plan view indicating how the so-called offset angle arises in bending the strip, FIGS. 5 and 6 are graphs showing characteristics which are derived empirically and subsequently stored in a microcomputer, controlling the operation of the machine, and FIG. 7 is a logic diagram showing how the microcomputer modifies the input data to take account of spring-back compensation and offset angle.

DETAILED DESCRIPTION OF THE DRAWINGS

Figure 1:
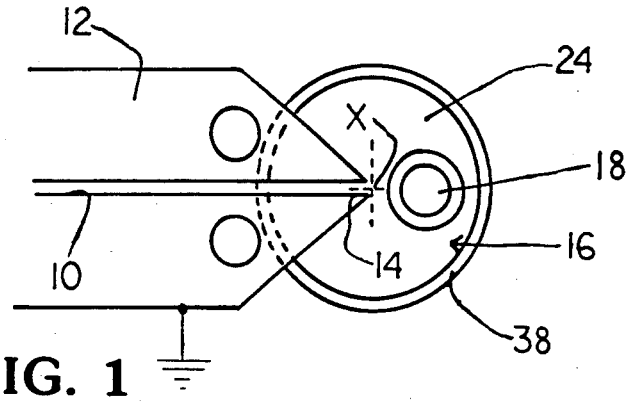
Figure 2:
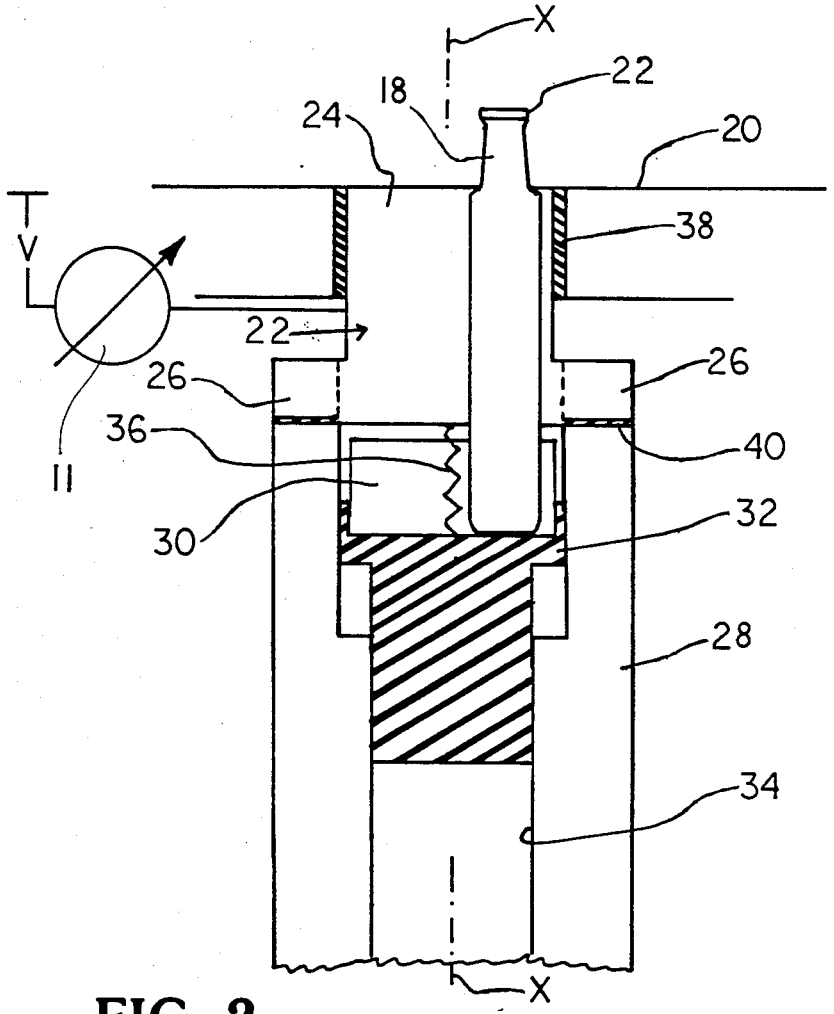

Referring to FIGS. 1 and 2, metal strip to be bent is fed by longitudinal feeding means (not shown) along a slot 10 formed by guide means 12. The exit end 14 of the slot 10 is coincident with the vertical pivot axis X of a generally cylindrical bending head 16 carrying a bending tool in the form of a pin 18. The axis of the pin 18 is spaced from the pivot axis X by a distance which is conveniently between 6 and 10 mm, preferably 8.5 mm. In its normal position for bending the strip, the pin 18 projects from the table surface 20 (FIG. 2) of the machine, the upper end of the pin 18 having a projecting shoulder 22 for engaging the strip.

The pin 18 is mounted for vertical sliding movement within a metal block 22 of the head 16. The block 22 has a cylindrical body 24 and two radially projecting lugs 26 which fit within opposed radial slots formed in the upper end of the wall of a brass cylinder 28. The brass cylinder 28 is rotated about the axis X by an actuater (not shown) to cause the pin 18 to undergo controlled lateral movement and thereby engage and bend the strip about the axis X. The lower end of the pin 18 extends through a metal plug 30 and rests against the recessed upper end of a piston 32 slidable in a pneumatic cylinder 34. Pressure air admitted to the cylinder 34 forces the piston 32 upwards and thereby moves the pin 18 to the operative projecting position. Two return springs, indicated diagrammatically at 36, act between the underside of the block 22 and the piston 32 to move the pin 18 to the retracted position to enable the pin to move to the other side of the strip for bending in the opposite sense.

The angle of rotation of the bending head 16, the retraction and extension of the pin 18 and the longitudinal movement of the strip are carried out in a controlled manner to effect a series of incremental bends the cumulative effect of which imparts the desired profile to the strip being bent. The strip is clamped against longitudinal movement during bending of the strip by the pin 18.

The pin 18 is insulated from the strip and from the remainder of the machine by electrically insulating components shown shaded in FIG. 2. A plastics bearing 38 insulates the block 22 from the surrounding machine structure, the lugs 26 are insulated from the brass cylinder 28 by a plastics film 40 and the piston 32 is of an electrically insulating material. An electrical connection is made to the block 22 and the pin is held at a potential such as 5 volts. When the pin 18 touches the strip (which is engaged by the grounded guides 12) the voltage on the pin 18 drops to zero, so that sensing of this voltage by the sensor 11 gives an indication of when the pin and strip are in contact.

Figure 3:
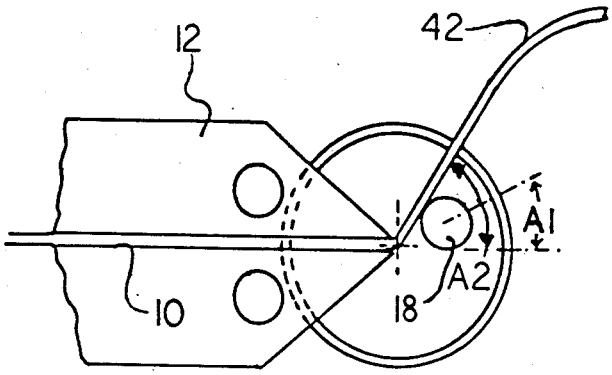

In FIG. 3 the metal strip being bent is shown at 42. After applying each bend to the strip by rotation of the head 16, the strip 42 tends to spring back. To inspect or check the permanent deformation applied to the strip 42, the head 16 is rotated so that the pin 18 moves towards the previously bent strip. The electrical potential of the pin 18 is monitored and when this potential drops to zero the microcomputer notes the angle A1 of the head 16. From the angle A1 the microcomputer derives the permanent angular deformation A2 from the characteristic shown in FIG. 5.

Figure 5:
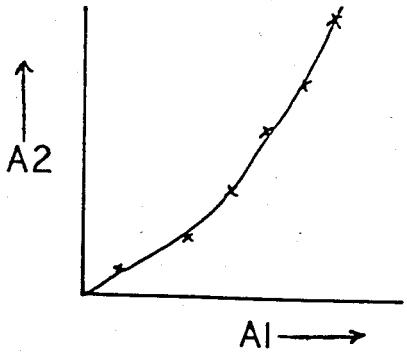

The characteristic shown in FIG. 5 is derived as an initial calibration step when the machine is first set up. Metal strips having known angles of bend A2 are placed in the machine and the bending head 16 rotated until the tool 18 makes electrical contact with the strip. As before, contact is detected by the potential of the pin 18 falling to zero. The microcomputer stores the set of angles A1 corresponding to the known angles A2 and fits a sixth order polynomial through the points to give the resulting characteristic shown in FIG. 5.

To compensate for spring-back of the metal strip, the bending head 16 is rotated through an angle which, after spring-back, gives the desired angle. This compensation relies on the characteristic shown in FIG. 6 which relates actual rotation A4 of the bending head 16 to the resulting permanent angular deflection A5 of the strip. The FIG. 6 characteristic is derived as a preliminary step before each batch of strip is bent. This may be regarded as calibration for the characteristics of the metal strip batch. The bending head 16 is rotated through a number of angles A4 and the resulting permanent angular deflection measured by subsequently bringing the pin 18 up to the strip, noting the angle of the pin 18 at which pin/strip contact occurs and deriving the corresponding permanent bend angle A5 from the characteristic of FIG. 5.

Figure 6:
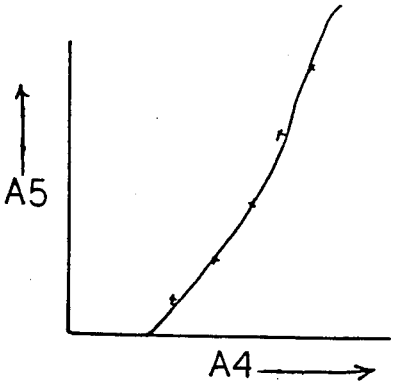

A sixth order polynomial is fitted through the points to give the FIG. 6 characteristic which is held in the microcomputer. A number of such characteristics may be stored, and any characteristic may be modified to take account of any departures revealed by the inspection step.

Figure 4:
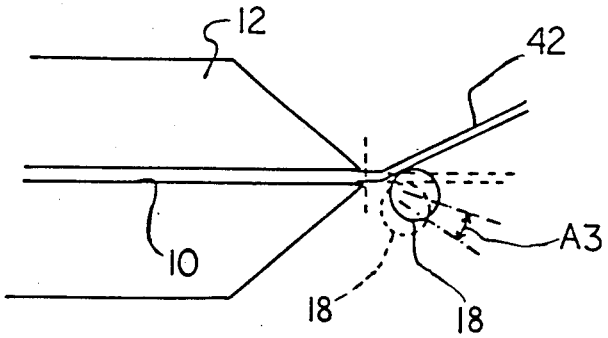

FIG. 4 illustrates an example of a situation in which offset compensation is provided for added accuracy of the bend applied to the strip 42.

Where an increment of longitudinal feed of the strip 42 is less than the spacing of the pin 18 from the axis X, the pin 18 must move to the solid line position to make contact with the strip 42 whereas, in the absence of offset compensation, the microcomputer would expect the pin 18 to make contact with the strip in the dotted line position of the pin 18. The angle A3 which must be corrected is the offset angle, and the magnitude of this angle in any given situation will depend on the number and magnitude of the bends between the line of action of the pin and the exit end 14 of the slot 10. The offset angle can be calculated trigonometrically and this is done by the microcomputer using data relating to previous bends.

Figure 7:
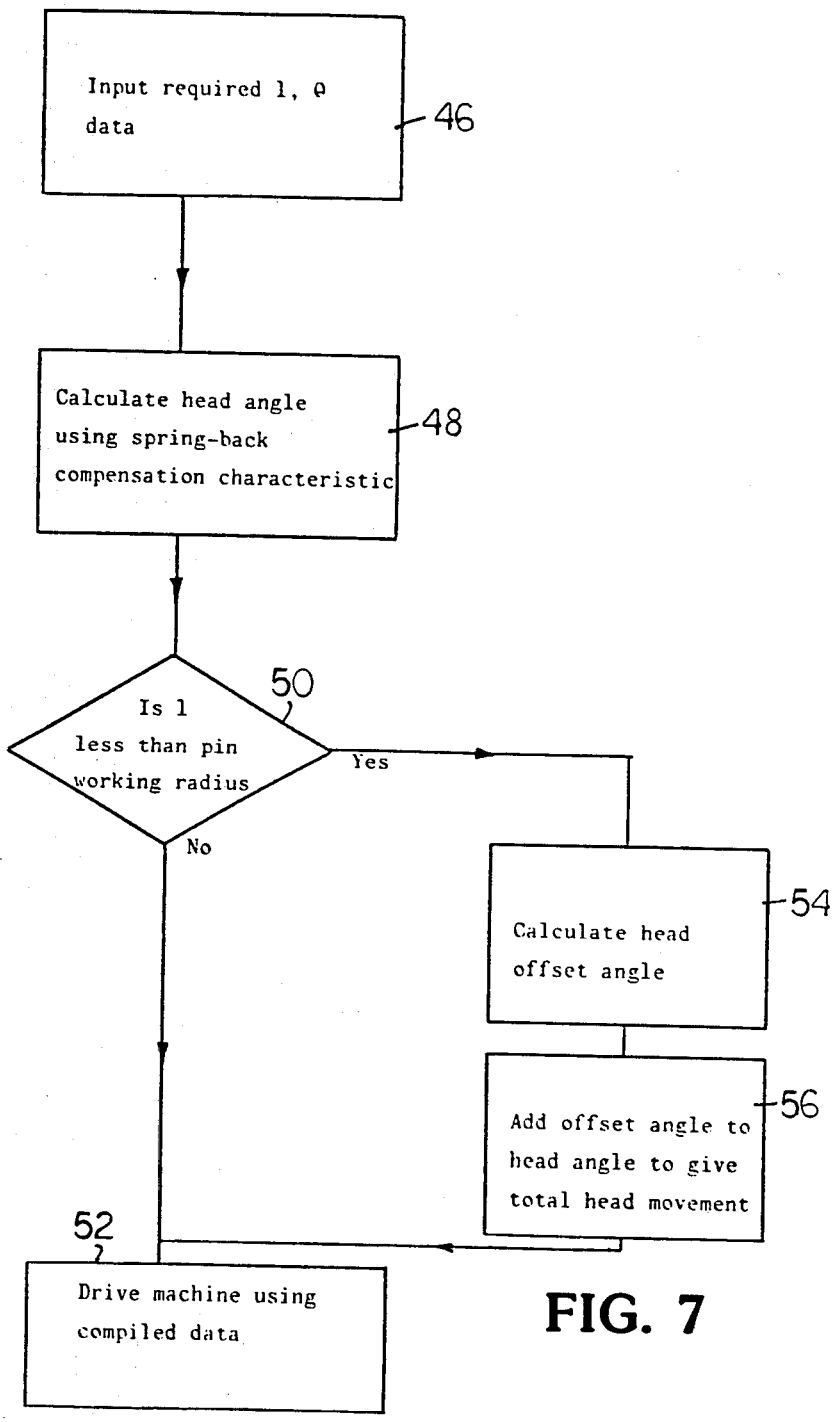

FIG. 7 is a logic diagram illustrating how spring-back compensation and offset compensation are applied in practice. The data generated by the microcomputer is in the form of a series of instructions consisting of longitudinal feed instructions (1) and bend angles ($\theta$). This data 46 is modified in the spring-back compensation stage 48 which alters the instructed bend angles in accordance with FIG. 6. Decision block 50 governs whether offset compensation is necessary. If not, the data proceeds to stage 52. Should offset compensation be necessary the microcomputer computes the magnitude and sign in stage 54 and adds this to the bend angle in stage 56 to give a final bend instruction which is used to control rotation of the bending head 16.

We claim:

1. A machine for bending metal strip comprising
grounded guide means for guiding metal strip to an exit location,
a bending tool having a working surface for contacting the metal strip,
bending tool support means including
means for supporting said bending tool for displacement along an axis,
means for displacing said bending tool along said axis from a retracted position below the metal strip to an advanced bending position,
said bending tool being spaced from said exit location and mounted in said support means,
said bending tool being displaceable from a retracted position along a path normal to said axis to contact and bend the metal strip and being displaceable back to said retracted position,
means connected to said bending tool for applying a voltage potential directly to said working surface of said bending tool,
means connected to said bending tool for sensing the presence or absence of such applied voltage, and
insulating means for preventing such applied voltage from being grounded through said bending tool support means whereby when said bending tool contacts the metal strip, said sensing means will sense that the applied voltage has dropped to zero and determine the exact location of the metal strip at the moment of contact or at the moment when contact is broken.

2. A machine for bending metal strip according to claim 2, wherein said path of movement normal to said axis is an arcuate path about a second axis parallel to said first axis.

3. A machine for bending metal strip according to claim 2, wherein said second axis passes through said exit location.

4. A machine for bending metal strip according to claim 1, wherein said means for displacing said bending tool along said first axis comprises a pneumatic cylinder.

* * * * *